US005455396A

United States Patent [19]

Willard et al.

[11] Patent Number: 5,455,396

[45] Date of Patent: Oct. 3, 1995

[54] TEMPERATURE/ENVIRONMENT-RESISTANT TRANSDUCER SUSPENSION

[75] Inventors: Charles L. Willard, Castaic, Calif.; Earl R. Geddes, Livonia; Robert H. Benedict, Ann Arbor, both of Mich.

[73] Assignees: JBL Incoporated, Northridge, Calif.; Ford Motor Company, Dearborn, Mich.

[21] Appl. No.: 327,441

[22] Filed: Oct. 21, 1994

Related U.S. Application Data

[63] Continuation of Ser. No. 36,959, Mar. 25, 1993, abandoned.

[51] Int. Cl.[6] ..... H04R 7/00; F01N 1/06

[52] U.S. Cl. ..... 181/172; 181/206

[58] Field of Search ..... 181/167, 169, 181/171, 172, 173, 174, 206; 381/71, 162, 188, 193, 205

[56] References Cited

U.S. PATENT DOCUMENTS

| | | | |
|---|---|---|---|
| 1,891,566 | 12/1932 | McKellip | 181/172 |
| 3,767,004 | 10/1973 | Liebcher | 181/171 |
| 3,997,023 | 12/1976 | White | 181/171 |
| 4,122,314 | 10/1978 | Matsuda et al. | 181/172 X |
| 4,676,853 | 6/1987 | Lerma | 156/87 |
| 5,099,949 | 3/1992 | Mitobe | 181/171 |
| 5,111,510 | 5/1992 | Mitobe | 181/172 X |
| 5,115,474 | 5/1992 | Tsuchiya et al. | 181/172 X |
| 5,233,137 | 8/1993 | Geddes | 181/206 |

*Primary Examiner*—Khanh Dang
*Attorney, Agent, or Firm*—J. E. McTaggart

[57] ABSTRACT

For transducers such as loudspeakers and actuators which must operate at unusually low or high ambient temperatures, a robust resilient annular support member for mounting the vibratable diaphragm extends outwardly therefrom to the main frame. The support member is formed from silicone elastomer or a silicone rubber composite in a molding process which may be a constant temperature process, preferably transfer molding. A diaphragm and a surround member may be bonded together in the molding process by inserting the edge of the diaphragm into the cavity mold. The molding techniques of silicone rubber composites containing pulp and weave fiber grades of commercially available mix materials allow transfer, compression or injection molding of diaphragm suspension system members with good control of the mechanical properties and thickness. Particularly with regard to surround suspensions, the ability to mold silicone rubber composite in thin cross sections and to vary the thickness and undulation pattern in the resilient region adds a great degree of design freedom.

19 Claims, 2 Drawing Sheets

TEMPERATURE/ENVIRONMENT-RESISTANT TRANSDUCER SUSPENSION

This application is a continuation of application Ser. No. 08/036,959, filed Mar. 25, 1993, now abandoned.

FIELD OF THE INVENTION

The present invention relates to acoustic transducers and more particularly it relates to improvements in the structure and manufacture of diaphragm-suspension members of actuators and loudspeakers of the moving voice coil/diaphragm type for use in harsh environments at unusually low and high ambient temperatures.

BACKGROUND OF THE INVENTION

The moving voice coil/diaphragm type transducer configuration has been utilized widely in loudspeakers, where the main moving diaphragm is typically but not necessarily conical in shape with its inner edge attached to a voice coil bobbin. Typically there are two resilient suspension members: a spider attached to the voice coil bobbin generally near the region where the bobbin is attached to the cone, and a surround member forming an annular border strip having its inner edge attached around the outer edge of the cone and its outer edge attached to a peripheral flange of the speaker frame. Both of these suspension members are required to provide the cone/voice coil assembly with elastic freedom to move back and forth over large excursions along the central axis while at the same time providing sufficient lateral stiffness to hold the voice coil and bobbin concentrically aligned within the gap between the magnetic poles.

It is quite difficult to find suitable materials that will act satisfactorily as suspension members in a hostile environment such as an automotive exhaust pipe where the temperature can range from –40 to +600 deg. F. (–40 to 316 deg. C.), compared to a much narrower range, typically 0 to 150 deg. F. (–18 to 66 deg. C.) over which ordinary loudspeakers are designed to operate.

For this severe duty, generally most materials will be found unsuitable in either fatigue endurance, acoustic properties or flexural properties, when subjected to extreme heat and cold.

RELATED PRIOR ART

U.S. Pat. No. 3,767,004 to Liebscher discloses a loudspeaker utilizing a thin flat surround member around the outside of the cone, which receives its full support from a double spider rear suspension system, thus removing all stresses from the surround member so that it serves merely as an air separator rather than as a suspension member. In Liebscher's flat surround configuration, the material is unstressed in an inactive condition, and is required to stretch isotropically, i.e. omnidirectionally, with cone displacement.

The foam material utilized by Liebscher is specified to be of the closed cell type (i.e. containing bubbles); such material is essentially not moldable into a required shape because necessary pressurization would make it impossible to control the resulting thickness of the surround material when the pressure is released. Thus the usefulness of foam material in loudspeaker surrounds is limited to flat non-supportive members such as the Liebscher surround which requires no lateral stiffness and thus can be made inexpensively from sheet foam stock cut to the required outline and used in flat form.

Many loudspeakers of known art use a type of surround suspension which is cut from a sheet of fibrous material such as soft paper and press-formed to have annular corrugations so as to provide some degree of lateral stiffness along with flexibility to vibrate axially; however such suspensions are well known to be fragile and tend to have short life expectancy especially under harsh environmental conditions including temperature extremes.

OBJECTS OF THE INVENTION

It is a primary object of the present invention to provide a robust loudspeaker surround suspension member in which a specially selected material is particularly configured to provide uniform resilience in the direction of vibration and sufficient lateral stiffness to provide concentric control of the voice coil, and which can withstand large temperature variations while providing the required amount of excursion without sacrificing fatigue resistance and/or acoustic efficiency.

It is a further object of the invention that the material selected for the surround suspension member be suitable for manufacturing methods which allow freedom and flexibility in shaping the selected material to optimal form for best realization of the primary object of the invention.

SUMMARY OF THE INVENTION

The above objects have been met in the present invention of voice coil/cone suspension members made from silicone rubber or a silicone rubber composite of dense non-cellular structure as distinguished from an open porous or cellular structure such as is found in foam rubber materials, that is molded into the shape of a suspension member in a constant temperature molding process, preferably transfer molding. The ability to mold silicone rubber composite in thin cross sections adds a great degree of freedom in designing a surround system. The molding techniques of this material allow injection, transfer and compression molding of a suspension member with good control of the shape, mechanical properties and thickness, particularly with regard to the surround suspension member. Molding enables the cross-section of the surround to be made in the shape of one or more arcuate half-rolls which operate on the principle of anisotropic hoop tension to hold the voice coil well centered while allowing freedom to vibrate.

BRIEF DESCRIPTION OF THE DRAWINGS

The above and further objects, features and advantages of the present invention will be more fully understood from the following description taken with the accompanying drawings in which:

FIG. 2 shows a half-roll surround member molded onto a diaphragm edge.

FIG. 3 shows a half-roll surround member adhesively attached to the diaphragm edge.

FIG. 4 shows a half-roll surround member formed with variations in thickness.

FIG. 5 shows a multiple roll surround member molded onto a diaphragm edge.

DETAILED DESCRIPTION

Figure 1:
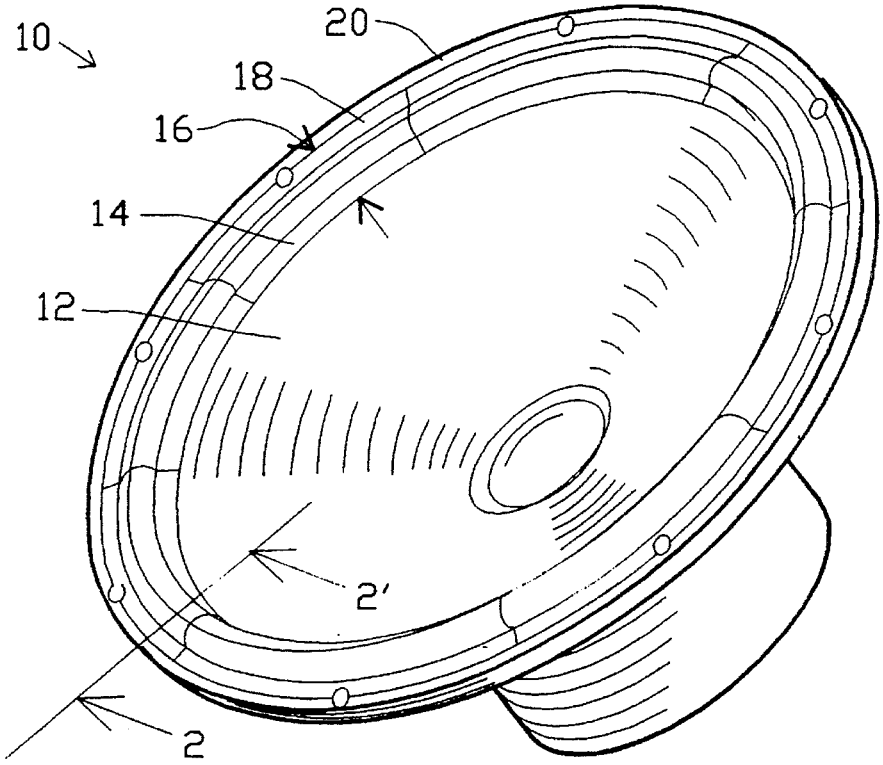
FIG. 1 is a perspective view of a typical transducer showing the location of the surround member.

In FIG. Is a typical transducer 10 is depicted in a perspective frontal view showing the cone shaped diaphragm 12 attached around its outer edge to the inner edge 14 of a surround member 16 which is in turn attached by its outer edge 18 to the peripheral flange 20 of the frame of transducer 10.

Figure 2:
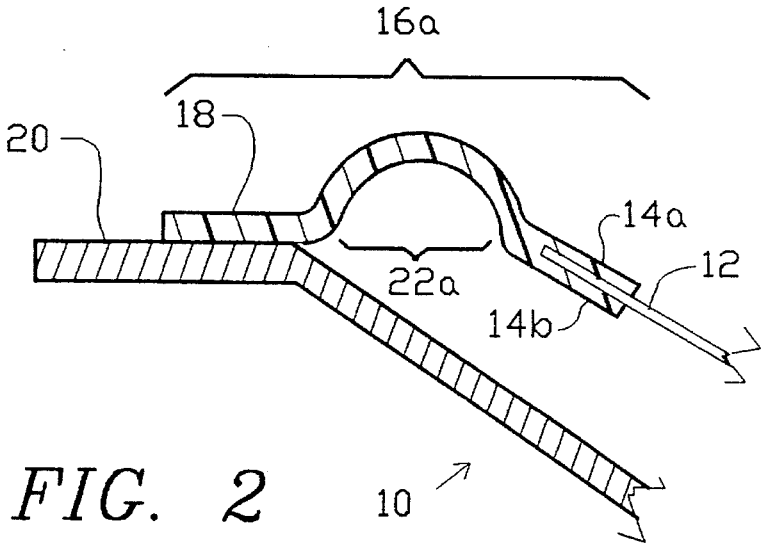
FIGS. 2–5 are cross sectional views of the surround support region of a transducer as implemented in different embodiments of the present invention.

FIG. 2 is a cross sectional view of an edge region of transducer 10 as viewed at radial axis 2—2' of FIG. 1. In this embodiment of the invention, a surround member **16*a* is molded from silicone rubber or a composition thereof; the inner edge bifurcated to form two lips 14*a* and 14*b*, between which diaphragm 12** is sandwiched and bonded in place by a molding process or by an adhesive.

The surround member **16*a* is seen to have a half-roll arched portion 22*a* which provides the main axial compliance, and a flat outer edge 18 by which it is attached to flange 20 of the transducer 10**, typically by adhesive bonding.

Figure 3:
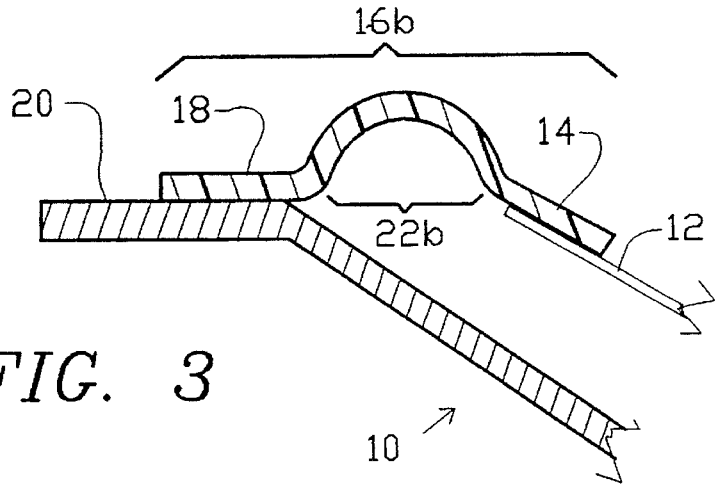

FIG. 3 shows a surround member **16*b* having a half roll arched portion 22 similar to that of FIG. 2, however in this embodiment the inner edge 14 is made flat and attached on its lower surface to diaphragm 12** by adhesive bonding.

Figure 4:
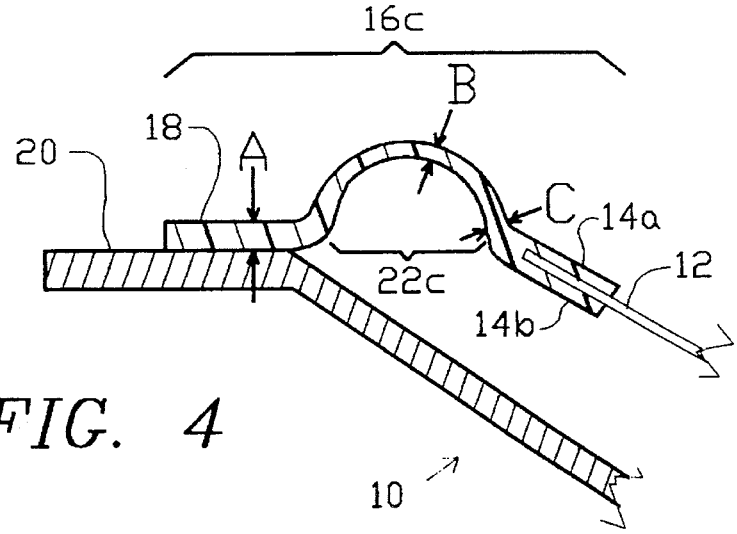

FIG. 4 illustrates another embodiment of the invention wherein the surround member **16*c* is made to have different thickness at different regions of the cross section. The thickness dimension B in a central region of arched portion 22 is made less than the thickness dimension A at outer edge 18; also the arched portion 22 is made thicker at dimension C near the bifurcated inner edge 14*a*, 14*b*. In this example the inner edge is shown as in FIG. 2, i.e. bifurcated with lips 14*a* and 14*b* for molded attachment to the diaphragm 12; however, the concept of varying the thickness is also applicable in the case of one-sided adhesive edge attachment as shown in FIG. 3. As an example of varying the thickness of the surround member 16*c*, for a 6" round loudspeaker, dimensions A and C may be made 0.03" (0.76 mm) while dimension B is made to be 0.015" (0.38 mm). The values selected will depend on several design parameters such as the size of the transducer, the molding process and the composition of the silicone rubber material. This variation in thickness, which is readily implemented in a molding process by shaping the cavities as required, provides design flexibility to increase the axial compliance and its linearity while preserving lateral stiffness for centering purposes and providing a robust region for attachment at the outer edge 18 and the inner edge 14**.

Figure 5:
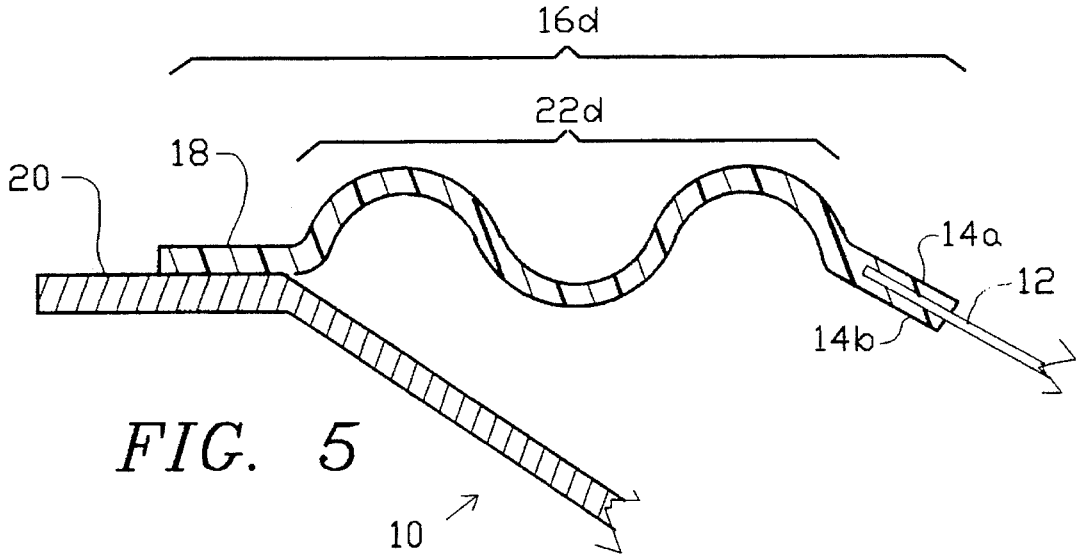

FIG. 5 shows an example of an alternative configuration for the surround member **16*d* in which the resilient portion 22*d*** is made with multiple rolls as shown in place of the half roll configuration of the foregoing embodiments. In this instance there are three half rolls approximating three adjacent semicircles: this concept can be extended to any number of multiple rolls, typically there will be an odd number of half rolls. The concept of multiple rolls may be applied in the same manner as described above for a single half roll: i.e. in combination with molded attachment, adhesive attachment and/or thickness variation.

In implementing this invention silicone rubber alone will provide improvements over prior art. Further enhancement may be obtained by adding other material to the silicone to form a composite silicone molding material, typically pulp and weave fiber grades of the mix materials such as those sold under Kevlar, Nylon, Nomex and Fiberglass, as selected to provide desired mechanical, acoustic and fatigue resistant properties of the silicone suspension member. In an example of a viable composite material for this purpose, fiber pulp sold under Kevlar is added to the silicone elastomer material in an amount of 1.5% by weight.

Regarding molding processes, transfer molding has been found most satisfactory and economical, and is typically performed at a pressure of 200 to 300 psi and a temperature around 350 degrees F. (177 deg. C.). As an alternative constant temperature molding process, compression molding could be utilized. It would also be possible to injection mold preheated material in a thermal cycle process. Material thickness typically ranges from 0.017" (0.43 mm) to 0.025" (0.63 mm).

A round speaker configuration is shown in FIG. 1 as illustrative: the invention is equally applicable to other speaker shapes such as elliptical or rectangular.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. In an acoustical transducer for extreme temperature usage in an unusually harsh environment, said transducer being of the type having a main body and a diaphragm that is vibratable relative to the main body, an improved resilient support structure, for supporting the diaphragm from the main body, comprising:

a suspension member, composed of a dense non-cellular silicone rubber material such that said suspension member operates reliably over an extremely wide temperature range, having an outer edge portion attached to the main body, an inner edge portion attached to the diaphragm, and a resilient region extending between the outer and inner edge portions.

2. The improved resilient support structure as defined in claim 1 wherein said suspension member is uniformly composed of a dense silicone rubber material that has been formed from a silicone molding composition containing up to 10% by weight of commercial fibrous mix material in a substantially constant temperature molding process.

3. The improved resilient support structure as defined in claim 1 wherein said suspension member is uniformly composed of a dense silicone rubber material that has been formed from a silicone molding composition containing up to 10% by weight of commercial fibrous mix material in a transfer molding process.

4. The improved resilient support structure as defined in claim 1 wherein said suspension member is uniformly composed of a dense silicone rubber material that has been formed from a silicone molding composition containing up to 10% by weight of commercial fibrous mix material in a compression molding process.

5. The improved resilient support structure as defined in claim 1 wherein said suspension member is uniformly composed of a dense silicone rubber material that has been formed from a silicone molding composition containing up to 10% by weight of commercial fibrous mix material in an injection molding process.

6. The improved resilient support structure as defined in claim 1 wherein the main body of the transducer is provided with a circumferential flat mounting surface, and wherein the outer edge of said suspension member is adhesively bonded to the mounting surface.

7. The improved resilient support structure as defined in claim 1 wherein the diaphragm is provided with a circumferential attachment region and the inner edge portion of said suspension member is adhesively bonded to the attachment region.

8. The improved resilient support structure as defined in claim 1 wherein the diaphragm is provided with a double-sided circumferential flat attachment region, the inner edge portion of said suspension member is configured With a parallel pair of edge flaps, and the flaps, being disposed so as to flank the attachment region of the diaphragm, are moldedly bonded thereto.

9. The improved resilient support structure as defined in claim 1 wherein said suspension member is molded to have a shape, at a radial cross section, defining an arch in the resilient region.

10. The improved resilient support structure as defined in claim 9 wherein the shape of said suspension member, as formed in a mold, is made to have a graduated thickness variation such that a central portion of the arch is made thinner than the outer edge portion and thinner than an end region of the arch adjacent the inner edge portion.

11. The improved resilient support structure as defined in claim 1 wherein said suspension member is molded to have a radial cross sectional shape defining a series of undulations in the resilient region.

12. The improved resilient support structure as defined in claim 11 wherein the shape of said suspension member as molded is made to have a predetermined pattern of graduated thickness variations in the resilient region.

13. The improved resilient support structure as defined in claim 1 wherein the diaphragm is provided with a circumferential attachment region and the suspension member is moldedly bonded to the attachment region of the diaphragm.

14. The improved resilient support structure as defined in claim 13 wherein said suspension member is composed of a dense silicone rubber material formed in a constant temperature molding process from a silicone molding material containing up to 10% by weight of commercial fibrous mix material.

15. The improved resilient support structure as defined in claim 1 wherein said suspension member is composed of a dense silicone rubber formed in a transfer molding process from a silicone molding material containing up to 10% by weight of commercial fibrous mix material.

16. In an acoustical transducer that is required to operate reliably over an extremely wide temperature range in an usually harsh environment, said transducer being of the type having a main body and a diaphragm that is vibratable relative to the main body, the diaphragm having a circumferential attachment portion, an improved resilient support structure for supporting the diaphragm from the main body, said support structure comprising:

an annular suspension member, composed of dense non-cellular silicone rubber material formed from a silicone molding composition containing up to 10% by weight of commercial fibrous mix material, the composition being such that said suspension member operates reliably over an ambient temperature range of at least −40° F. to +600° F., i.e. −40° C. to +316° C., said suspension member having a circumferential outer edge portion attached to the main body, an inner edge portion attached to the circumferential attachment portion of the diaphragm, and a concentrically-undulated resilient region extending between the outer and inner edge portions of said suspension member.

17. The improved resilient support structure as defined in claim 16 wherein the resilient region is made to have a radial cross-section shaped as an arch, and wherein said support structure is molded in a process selected from a group consisting of constant temperature molding, transfer molding, compression molding and injection molding.

18. The improved resilient support structure as defined in claim 16 wherein the circumferential outer edge portion thereof is adhesively attached to the main body, and the inner edge portion thereof is moldedly bonded to the circumferential attachment portion of the diaphragm.

19. In an acoustical transducer, for use in harsh environments, having a diaphragm that is vibratable relative to a main body of the transducer and that is provided with a pair of attachment surfaces one on each side of a circumferential portion thereof, an improved resilient support structure, for supporting the diaphragm from the main body, comprising:

an annular suspension member, composed of dense non-cellular silicone rubber material formed from a silicone molding composition containing up to 10% by weight of commercial fibrous mix material, the composition being such that said suspension member operates reliably over an ambient temperature range of at least −40° F. to +600° F., i.e. −40° C. to +316° C., said suspension member having a circumferential outer edge portion adhesively attached to the main body, an inner edge portion configured with a pair of flaps flanking the circumferential portion of the diaphragm and moldedly bonded to the attachment surfaces thereof, and a resilient region extending between the outer and inner edge portions thereof, the resilient region being made to have a radial cross section shaped as an arch of graduated varying thickness that decreases from each end thereof to a minimum thickness in a central region thereof.

* * * * *